US008166905B2

(12) United States Patent
Gratsch

(10) Patent No.: US 8,166,905 B2
(45) Date of Patent: May 1, 2012

(54) BOAT ACCESSORY MOUNTING APPARATUS

(76) Inventor: Gary L. Gratsch, Cincinnati, OH (US)

( * ) Notice: Subject to any disclaimer, the term of this patent is extended or adjusted under 35 U.S.C. 154(b) by 76 days.

(21) Appl. No.: 12/730,526

(22) Filed: Mar. 24, 2010

(65) Prior Publication Data

US 2010/0242828 A1 Sep. 30, 2010

Related U.S. Application Data

(60) Provisional application No. 61/163,224, filed on Mar. 25, 2009.

(51) Int. Cl.
*B63B 17/00* (2006.01)

(52) U.S. Cl. ..... 114/364; 410/116

(58) Field of Classification Search ..... 114/343, 114/364; 43/21.2; 410/101, 106, 107, 110, 410/111, 116
See application file for complete search history.

(56) References Cited

U.S. PATENT DOCUMENTS 4,836,127 A * 6/1989 Wille ..... 114/343
5,065,540 A * 11/1991 Potter, Jr. ..... 43/21.2
5,301,627 A 4/1994 Czipri
5,535,694 A 7/1996 Czipri
5,598,803 A 2/1997 Czipri
6,000,890 A * 12/1999 Macias ..... 410/116
6,125,779 A 10/2000 Czipri
6,155,195 A * 12/2000 Nirenberg ..... 114/343
6,234,101 B1 5/2001 Czipri
6,712,569 B1 * 3/2004 Wang et al. ..... 410/111

OTHER PUBLICATIONS

Attwood Neat Clean Retractable Cleat, http://www.discountmarinesupplies.com/Boat_Cleats-ATTWOOD, printed Mar. 11, 2010 (1 page).
Boat Cleats by Discount Marine Supplies, http://www.discountmarinesupplies.com/HARDWARE-Boat.Cleats.html, printed Mar. 11, 2010 (1 page).
Accon Marine, L.L.C., Superior Quality Flush-Mounted Marine Hardware & Accessories, brochure, undated (2 pages).
Aerial Wakeboarding Products, http;www.h2osportswarehouse.com/aerial-wakebard-tower-polished-aluminum-p/btair, printed Feb. 25, 2010 (1 page).
Universal Wakeboard Racks for Wakeboard Towers, http://shop.monstertower.com/c-4-tower-racks.aspx, printed Feb. 25, 2010 (1 page).
Accon Marine, LLC, New Larger Lifting Eye, flyer, undated (1 page).

* cited by examiner

*Primary Examiner* — Lars A Olson
(74) *Attorney, Agent, or Firm* — Wood, Herron & Evans, LLP

(57) ABSTRACT

A retractable mounting apparatus is provided for attaching boat accessories to a boat. In one embodiment, a mounting apparatus is provided for selectively securing an accessory to a structural portion of a boat. The apparatus has a housing that is configured for coupling to the structural portion of the boat, and a mounting element that is at least partially disposed in the housing. The mounting element is movable relative to the housing between a retracted position and an extended position above the structural portion. The mounting element is rotatable about the axis.

27 Claims, 8 Drawing Sheets

BOAT ACCESSORY MOUNTING APPARATUS

CROSS-REFERENCE TO RELATED APPLICATION

This application claims the filing date benefit of U.S. Provisional Application No. 61/163,224, filed Mar. 25, 2009, the contents of which are hereby incorporated by reference herein in their entirety.

TECHNICAL FIELD

The present invention is generally related to systems for selectively attaching accessories to boats.

BACKGROUND

In the boating industry, it is often desirable to attach accessories to a boat. For example, it is sometimes desirable to attach one or more of a ladder, a fishing rod holder, a grill, a trolling motor, a kicker motor, an electronic device, a table, a wakeboard tower, a canoe outrigger, a ski and wakeboard rack, a fishing downrigger, a rocket-type rod holder, a T-top style top, a diving tank holder, an umbrella, or a camera mount. In particular, it is often desirable to attach these accessories to or near the gunnel or some other structural portion of a boat including but not limited to the floor, bow, or stern of the boat.

Conventional ways of attaching these accessories to a boat include permanently drilling through the structural portion and permanently attaching the accessory thereto. Drilling of this type, however, detracts from the otherwise pleasant aesthetic appearance of the boat and/or may affect the structural integrity of the structural portion of the boat as a whole. Further, once an accessory is permanently attached, it cannot be easily removed or hidden from view, thereby affecting the overall aesthetic appearance of the boat itself. In addition to the above, permanently attaching these accessories, for example, to the gunnel of the boat, makes that portion of the gunnel unavailable for other uses or other attachments. In addition, in such case, the pre-defined length and shape of the gunnel limits the number of attachments that can be attached to the boat.

Accordingly, it would be desirable to have an apparatus and related method to address this and other problems associated with the attachment of accessories to a boat.

SUMMARY

According to embodiments of the present invention, a mounting system is provided for attaching boat accessories to a boat. According to embodiments of the present invention, a retractable mounting apparatus is provided for removably attaching one of a plurality of boat accessories to a boat. The mounting system provides a plurality of different accessories that may be removably and alternatively mounted to an accessible surface of the boat while being soundly secured to a structural portion of the boat.

In certain embodiments, a mounting apparatus is provided for selectively mounting an accessory to an accessible surface of a boat, such as, for example, to a deck, gunnel, bulkhead, cabin, or an exposed surface of the boat, while also securing the accessory to a structural portion of a boat, such as a frame or other part of the boat structure that is strong enough to structurally to support the accessory. The apparatus has a housing that is configured for coupling to the structural portion of the boat typically located behind or on an underside of a mounting surface of the boat to which the accessory is to be mounted. The apparatus also includes a mounting element that is at least partially disposed in the housing. The mounting element is movable relative to the housing between a retracted position and an extended position above the outer surface at which an accessory is to be mounted. The mounting element includes an engaging portion for receiving cooperating engaging portion of the accessory. For example, in certain embodiments, the engaging portion of the mounting element may include a channel in the mounting element configured to slidably receive the cooperating engaging portion on the accessory in the form of a key or other protrusion.

In a specific embodiment, the apparatus has a locking feature for securing a protrusion or other attachment structure of the accessory relative to a channel or other accessory engaging structure on the mounting element. The locking feature may, for example, include one of a screw that frictionally engages the protrusion of the accessory, a bayonet lock, or a quick-connect or other spring-loaded feature. The mounting element may be movable relative to the housing along an axis, with the mounting element being rotatable about the axis to thereby define a plurality of available angular positions of the mounting element relative to the housing. Alternatively or additionally, the apparatus may include a pin that is associated with one of the mounting element or the housing, and a plurality of slots in the other of that mounting element or the housing. The slots are adapted to receive the pin, with selective engagement of the pin with one of the slots being effective to lock the mounting element in a predetermined one of the available angular positions of the mounting element.

In certain embodiments, the mounting apparatus may include an encasement that extends from the housing and which includes a biasing element urging the mounting element in a direction toward the extended position. The mounting element may also include a latch and the housing may include a stop member that is selectively engageable by the latch to lock the mounting element in the retracted position. Additionally, the apparatus may include a pivotally-mounted element that is operatively coupled to the latch for selectively engaging and disengaging the latch relative to the stop member.

In another specific embodiment, the mounting element includes a top face, and the housing includes a flange for coupling the housing to the structural portion of the boat. The flange is positioned relative to a remainder of the housing so as to make the top face substantially flush with the top mounting surface of the boat to which an accessory is to be mounted. Additionally, the apparatus may include a pivotally-mounted lifting element that is engageable to move the mounting element upward toward the extended position, with the lifting element having a folded orientation in which the lifting element is generally flush with the top face.

In another embodiment, a mounting apparatus is provided for selectively securing an accessory to a structural portion of a boat. The apparatus includes a housing that is configured for coupling to an underside of the structural portion, and a mounting element that is at least partially disposed in the housing. The mounting element is movable relative to the housing along an axis between a retracted position and an extended position above the structural portion. The mounting element includes an engaging portion for engaging the accessory and is rotatable about the axis to define a plurality of available angular positions of the mounting element relative to the housing. The apparatus may be such that the engaging portion includes a pair of channels for slidingly receiving a corresponding pair of protrusions of the accessory.

Additionally, the apparatus may have a pin that is associated with one of the mounting element or the housing, and a plurality of slots in the other of the mounting element or the housing. The slots are adapted to receive the pin, and selective engagement of the pin with one of the slots is effective to lock the mounting element in a predetermined one of the available angular positions of the mounting element. The biasing element may urge the mounting element in a direction toward the extended position when the mounting element is in the retracted position, and urge the mounting element in a direction toward the retracted position when the mounting element is in the extended position. Rotation of the mounting element about the axis may be such that this rotation is effective to lock a vertical position of the mounting element relative to the housing.

In yet another embodiment, an assembly is provided for use in a boat that has a structural portion. The assembly includes a housing that is configured for coupling to an underside of the structural portion, and a mounting element that is at least partially disposed in the housing. The mounting element is movable relative to the housing along an axis between a retracted position within the structural portion and an extended position above the structural portion. The mounting element includes a first engaging portion and the assembly includes a boat accessory that has a second engaging portion that permits selective slideable engagement thereof with the first engaging portion of the mounting element.

Additionally, the assembly may include a plurality of boat accessories having respective second engaging portions that are selectively engageable with the first engaging portion of the mounting element. The mounting element may be rotatable about the axis to define a plurality of available angular positions of the mounting element relative to the housing. In a specific embodiment, the assembly includes a pin that is associated with the mounting element, and a plurality of slots in the housing and which are adapted to receive the pin. Selective engagement of the pin with one of the slots is effective to lock the mounting element in a predetermined one of the available angular positions of the mounting element.

In another embodiment, a boat is provided having a structural portion that has an exposed top surface and a structural member opposite the exposed top surface. The boat has a housing that is configured for coupling to the structural member, and a mounting element that is at least partially disposed in the housing and which is movable relative to the housing along an axis between a retracted position and an extended position above the structural portion. The mounting element has a first engaging portion and the boat includes a boat accessory that has a second engaging portion that is selectively engageable with the first engaging portion of the mounting element.

BRIEF DESCRIPTION OF THE DRAWINGS

The accompanying drawings, which are incorporated in and constitute a part of this specification, illustrate various embodiments of the invention and, together with a general description of the invention given above and the detailed description of the embodiments given below, serve to explain the embodiments of the invention.

DETAILED DESCRIPTION

Figure 1:
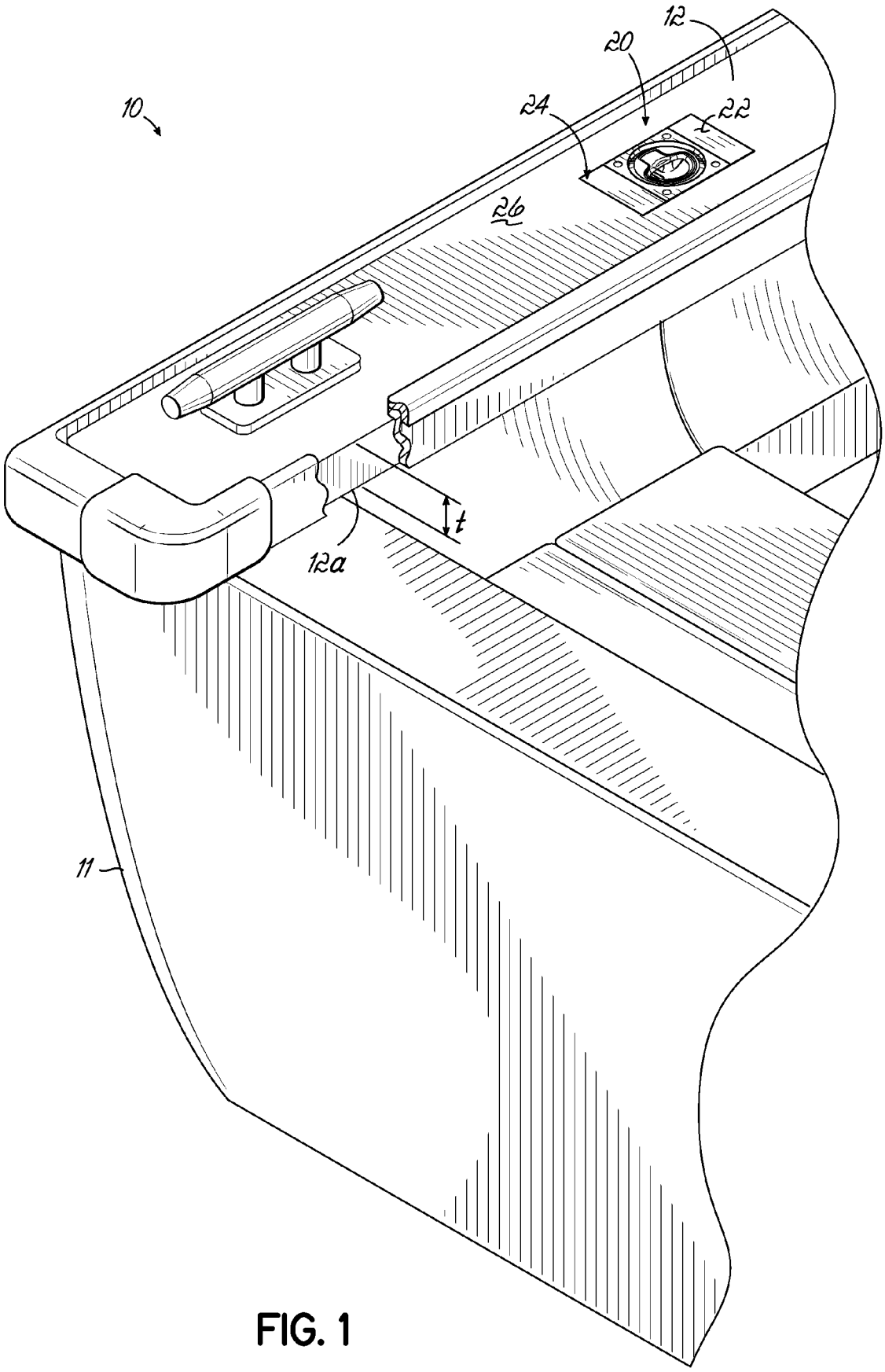
FIG. 1 is a partially broken away perspective view of a boat, including an exemplary embodiment of a mounting apparatus for selectively securing accessories to the boat.
Figure 1A:
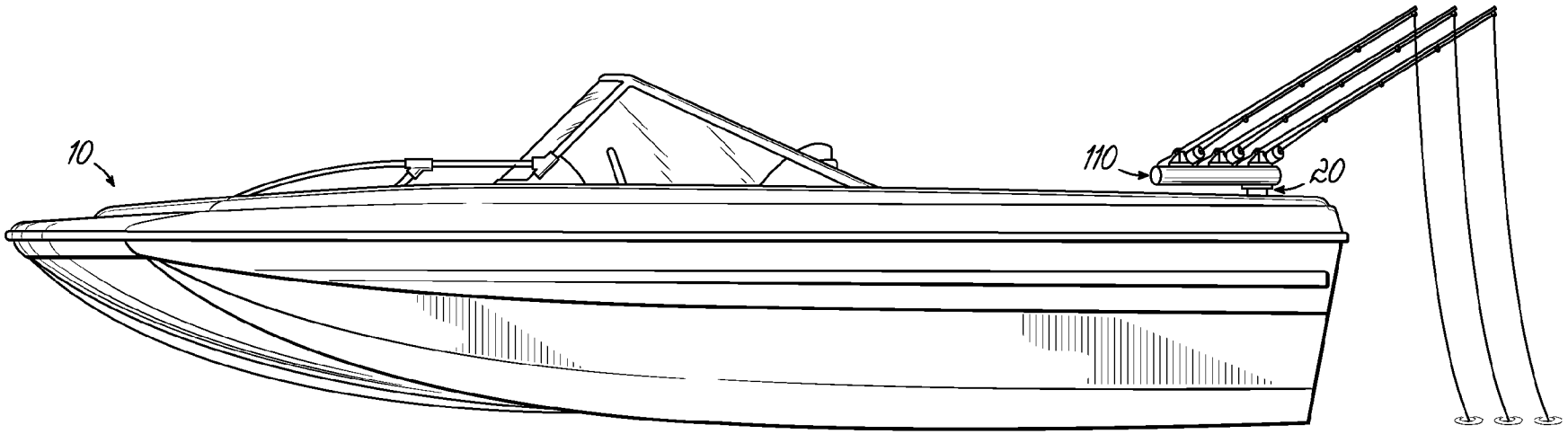
FIG. 1A is a diagrammatic view of a boat having an assembly including the mounting apparatus of FIG. 1 and an exemplary accessory coupled thereto.
Figure 2:
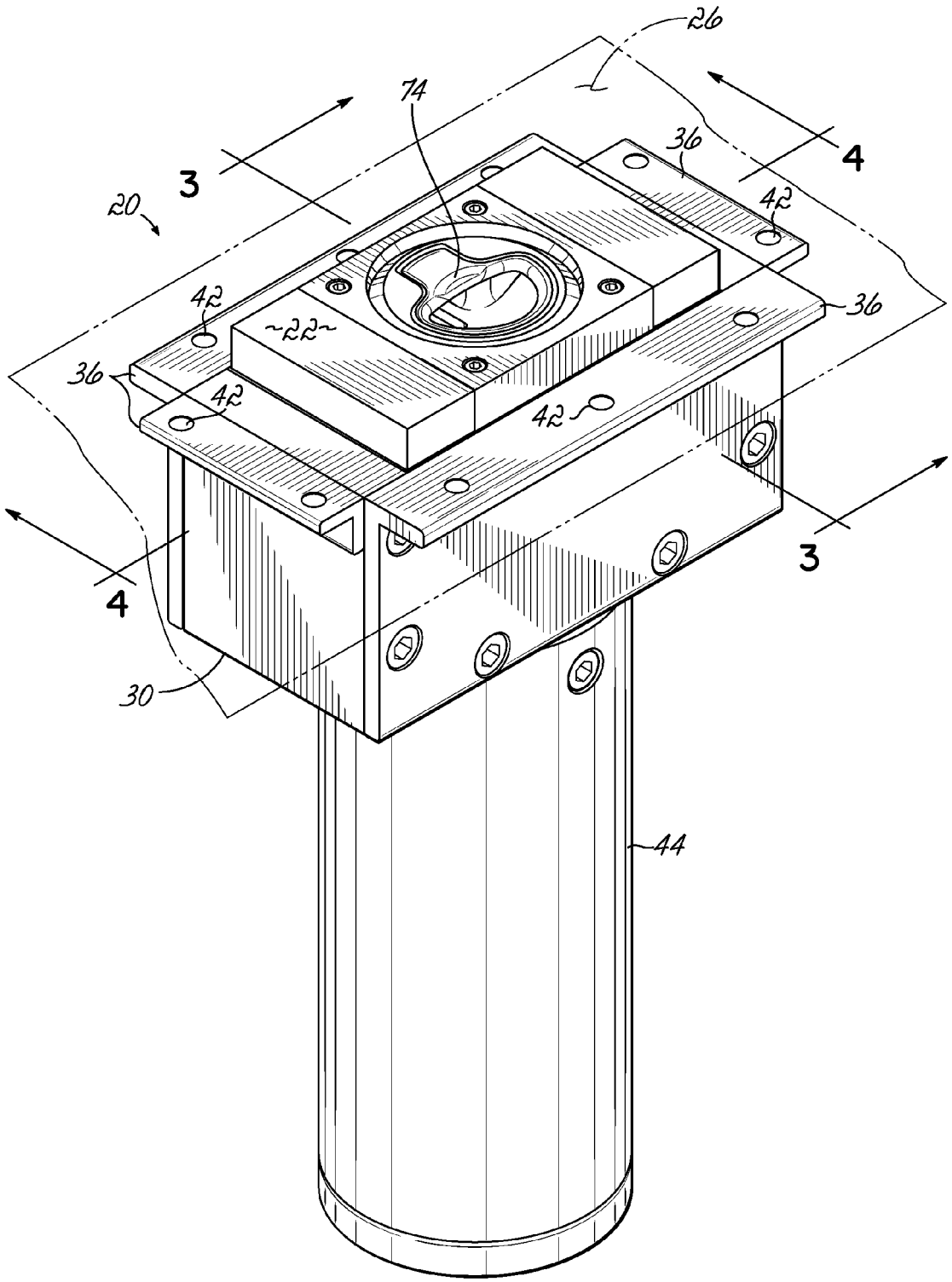
FIG. 2 is a perspective view of the mounting apparatus of FIG. 1.

With reference to FIGS. 1-2, a boat 10 includes a main portion 11 and an exemplary structural portion in the form of a gunnel 12 holding different types of attachment devices. Boat 10 includes a mounting apparatus 20 for selectively securing one of a plurality of available accessories to the gunnel 12 of the boat 10. While the embodiment of FIGS. 1-2 illustrate the mounting apparatus 20 being coupled to the gunnel 12, it is contemplated that mounting apparatus 20 may be additionally or alternatively coupled to any other structural portion of the boat such as, and without limitation, the floor, bow, stern, or roof of the boat 10. As illustrated in the figure, a top face 22 of a mounting element 24 of the apparatus 20 is substantially flush with an exposed, accessible top surface 26 of the gunnel 12, which enhances the aesthetics of the gunnel 12 when the apparatus 20 is not being used.

With particular reference to FIG. 2, the mounting apparatus 20 includes a main housing 30 and the above-noted mounting element 24, which is at least partially disposed within a cavity 29 (FIG. 4) of the housing 30. One or more flanges 36 extend laterally from the housing 30 to permit coupling of the apparatus 20 to an underside 12*a* of the gunnel 12, the top surface 26 of which is shown in phantom in the figure. To this end, the flanges 36 may include a plurality of holes 42 that permit engagement of a corresponding plurality of fasteners, such as screws or bolts (not shown), to the underside 12*a* of gunnel 12. It is contemplated that if the gunnel 12 of a particular boat is not sufficiently strong to support the contemplated accessories, the housing 30 may be attached instead to some other structurally strong member of the boat behind the gunnel 12. As illustrated in the figure, the axial position (in the vertical direction of FIG. 2) of the flanges 36 relative to the thickness "t" of the gunnel 12 is such that the top face 22 of the mounting element 24 is, as noted above, substantially flush with the top surface 26 of the gunnel 12 when the mounting element 24 is in a fully retracted position (FIG. 1).

An encasement 44 extends downward from the housing 30 of the apparatus 20 and includes a shaft 48 (FIG. 3) that is supported within the encasement 44 for restricting movement of the mounting element 24 relative to the housing 30. As discussed in further detail below, the mounting element 24 is movable along an axis 25, relative to the housing 30 of apparatus 20, to thereby define a retractable and rotatable system for temporarily and selectively coupling accessories to the gunnel 12. The mounting element 24 is thus selectively movable between a fully retracted position (FIGS. 1, 2-4, and 5A) and a fully extended position (FIGS. 5B, 5C, and 6), while being capable of attaining intermediate extended positions (not shown). The mounting element 24 and the other portions of the mounting apparatus 20 are made of one or more suitably chosen materials, such as, without limitation, metals or polymer-based materials that may be chosen, for example, to provide strength while minimizing the weight of the mounting apparatus 20.

Figure 3:
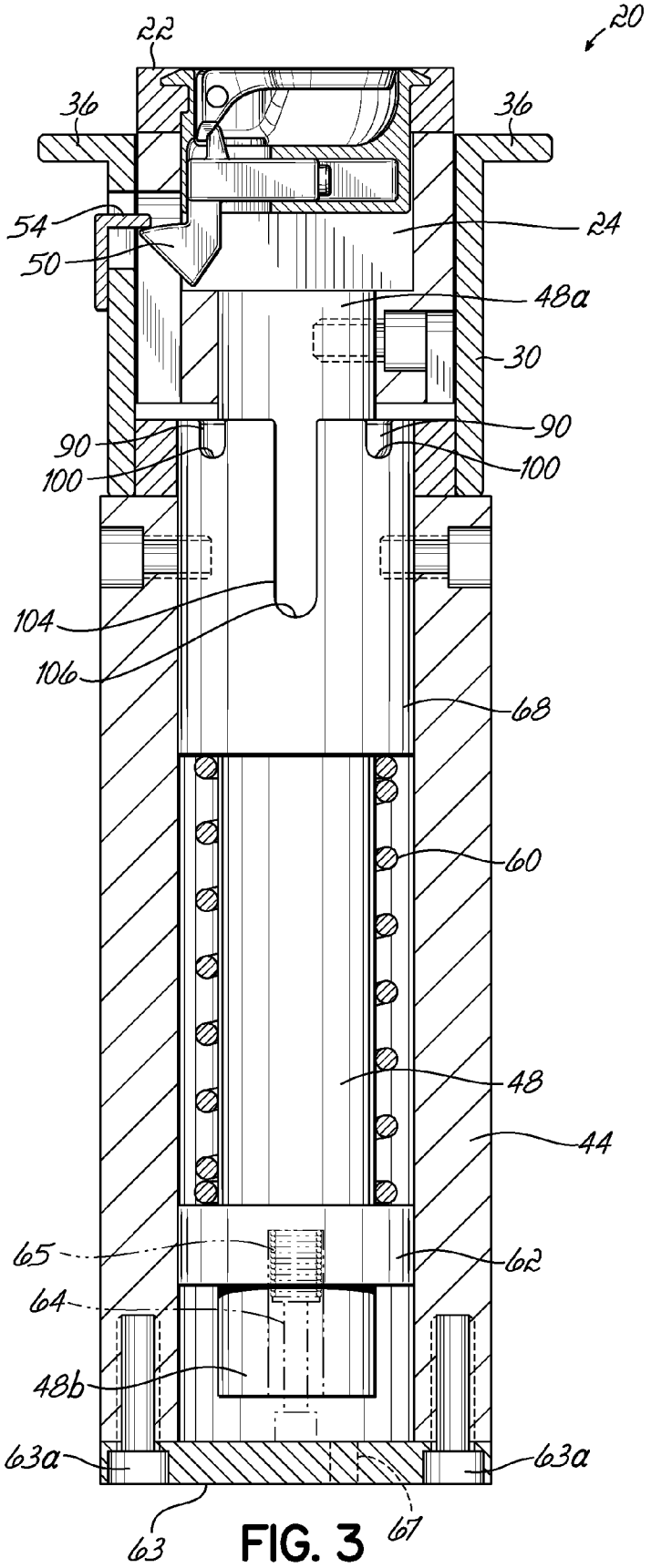
FIG. 3 is a cross-sectional view taken generally along line 3-3 of FIG. 2.
Figure 4:
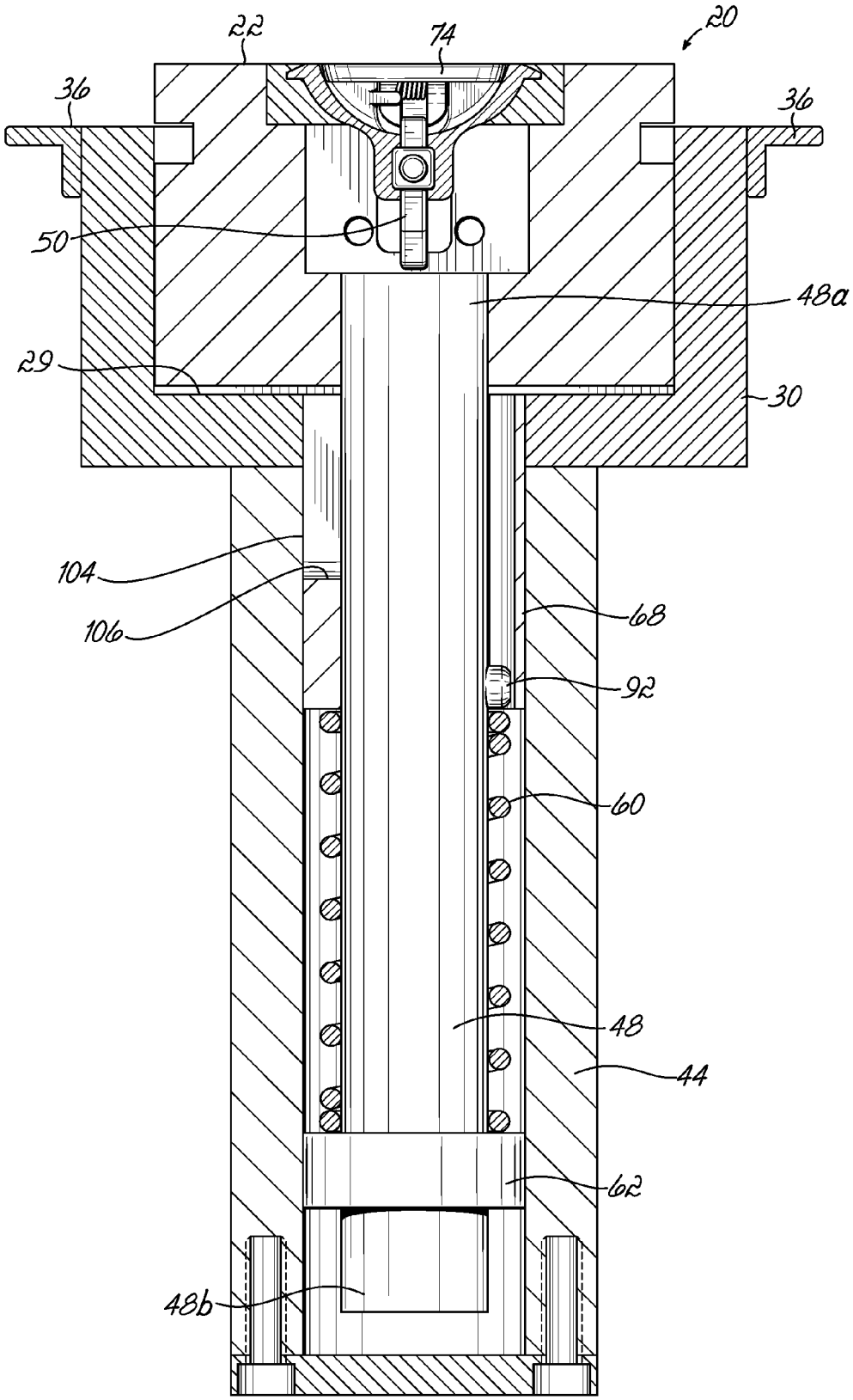
FIG. 4 is a cross-sectional view taken generally along line 4-4 of FIG. 2.

With reference to FIGS. 3 and 4, the mounting element 24 is coupled to a top end 48*a* of the shaft 48. A latch 50 is engageable with a stop member 54, in the form of a plate of the housing 30, to maintain the mounting element 24 in the position generally illustrated in FIGS. 3 and 4. A biasing element in the form of a dual-function (i.e., compression and tension) spring 60 is supported within the encasement 44, generally surrounding the shaft 48, to urge the mounting element 24 toward an extended position such as that shown in FIGS. 3 and 4, when the mounting element 24 is in the fully retracted position (FIG. 1). To this end, a bushing 62 coupled to a bottom end 48*b* of the shaft 48 and to the spring 60 urges the mounting element 24 upward in the direction of the upward force exerted by the spring 60. More specifically, when the mounting element 24 is in the fully retracted position (FIG. 1), the spring 60 urges the bushing 62 upward toward the natural shape (not shown) of the spring 60. Further, in this embodiment, spring 60 urges the mounting element 24 in a direction toward the fully retracted position when the mounting element 24 is in the fully extended position of FIGS. 5B and 5C, as more fully explained below.

In one aspect of the embodiment illustrated in FIG. 3, the encasement 44 includes a bottom cap 63 secured to the main portion of the encasement 44 via one or more fasteners (e.g., bolts) 63*a*. A centrally located pin 64 extends upward from the cap 63 and supports an auxiliary spring 65. Spring 65 is operatively coupled to the bushing 62 and thereby cooperates with the spring 60 to urge the bushing 62 upward when the mounting element 24 is in the fully retracted position. An optional weep opening or hole 67 extends through the cap 63 and permits the escape of fluid (e.g., water) from the interior of encasement 44. The presence of the weep opening 67 may be particularly desirable in view of the water-rich environment surrounding the mounting apparatus 20 during operation.

Figure 5C:
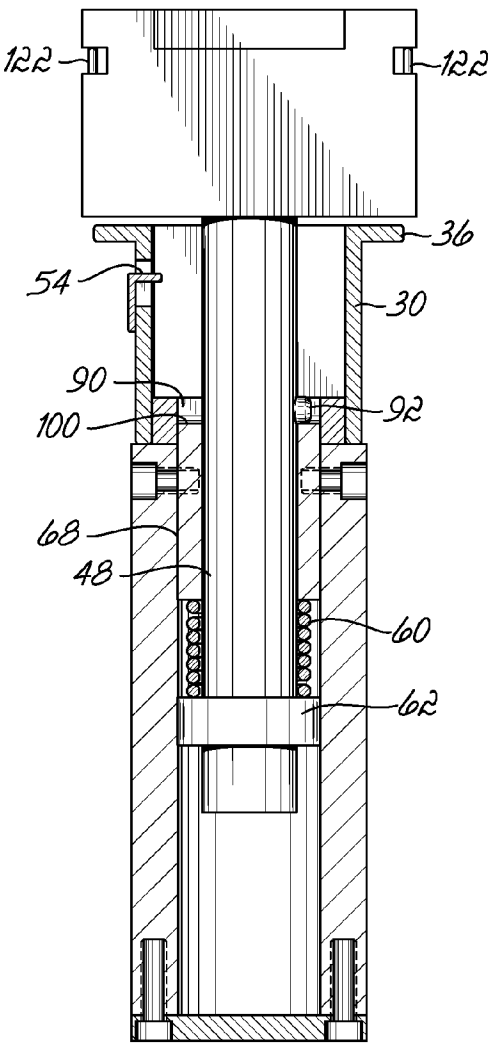
FIGS. 5A-5C are cross-sectional views illustrating movement of a mounting element of the apparatus of the preceding figures relative to a housing thereof.
Figure 5B:
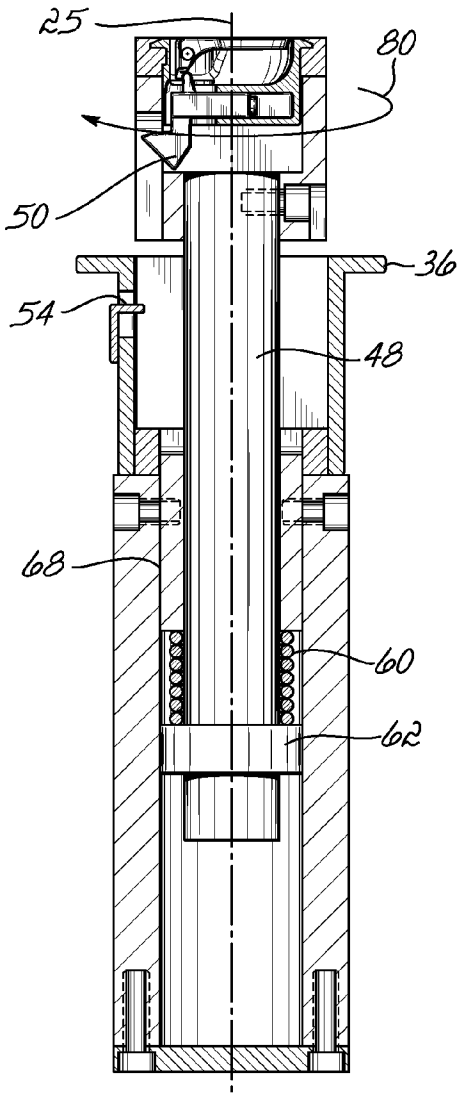
Figure 5A:
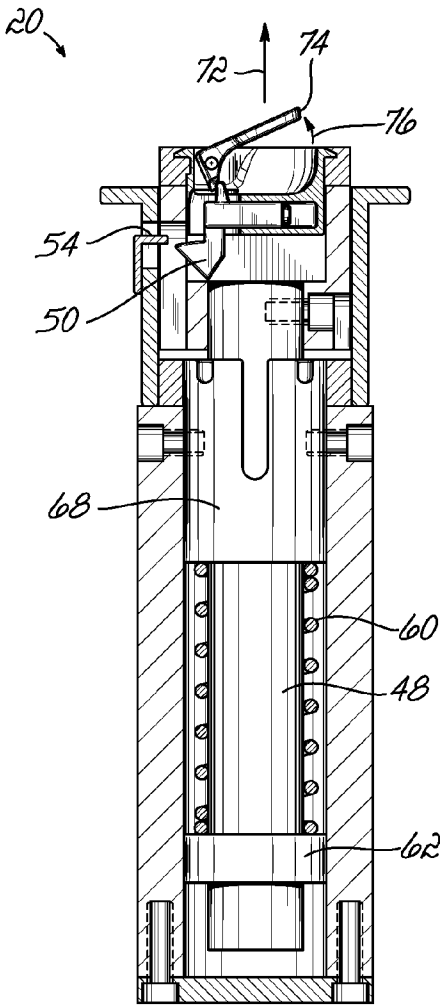

With respect to FIGS. 5A-5C, an exemplary operation of the mounting apparatus 20 is illustrated. In FIG. 5A, the latch 50 is shown being disengaged from the stop member 54 in the housing 30 to thereby permit upward vertical movement of the mounting element 24, along axis 25, in the general direction of arrow 72. To this end, a lifting element in the form of a handle 74 is coupled to the latch 50 and is adapted to receive a finger therethrough. Pivotal movement (arrow 76) of handle 74 is effective to cause pivotal movement of the latch 50 away from the stop member 54 in the housing 30. This pivotal movement of latch 50, in turn, allows spring 60 to push the mounting element 24 upward, toward the fully extended positions of FIGS. 5B and 5C. In the illustrated embodiment, the spring 60 pushes mounting element 24 upward until the spring 60 recovers its natural shape (not shown), which corresponds to an intermediate extended position of mounting element 24 between the positions illustrated in FIG. 5A and that of FIGS. 5B and 5C. Those of ordinary skill in the art will readily appreciate that alternative mechanisms may be employed to facilitate the above-discussed movement of the mounting element 24 relative to housing 30. For example, an alternative mechanism may be of a push-push type, in which the mounting element 24 may be pushed down from the intermediate position to the retracted position, whereupon it latches in the retracted position, and in which an additional downward push releases the mounting element 24 from its retracted position and moves under the force of a spring of such mechanism to the intermediate position.

With continued reference to FIGS. 5A-5C, an upward force may be applied by the user (e.g., manually) to pull the mounting element 24 from the intermediate extended position (not shown) to the fully extended position illustrated in FIGS. 5B and 5C. This force may be exerted, for example, by engagement of a user's hand with handle 74. Notably, in this embodiment, the handle 74 has a folded orientation, illustrated in FIGS. 2 and 6, in which it is substantially flush with the top face 22, which further enhances the aesthetic appearance of gunnel 12 when the mounting apparatus 20 is not in use. As the mounting element 24 moves upward from the intermediate extended position to the fully extended position (FIGS. 5B, 5C), bushing 62 compresses spring 60 against a sleeve 68 within encasement 44, thereby causing the spring 60 to attain a compressed shape relative to its natural shape (not shown). Compression of the spring 60, in turn, results in exertion by spring 60 of a downward force onto the mounting element 24, i.e., in a direction toward its retracted position.

Figure 7:
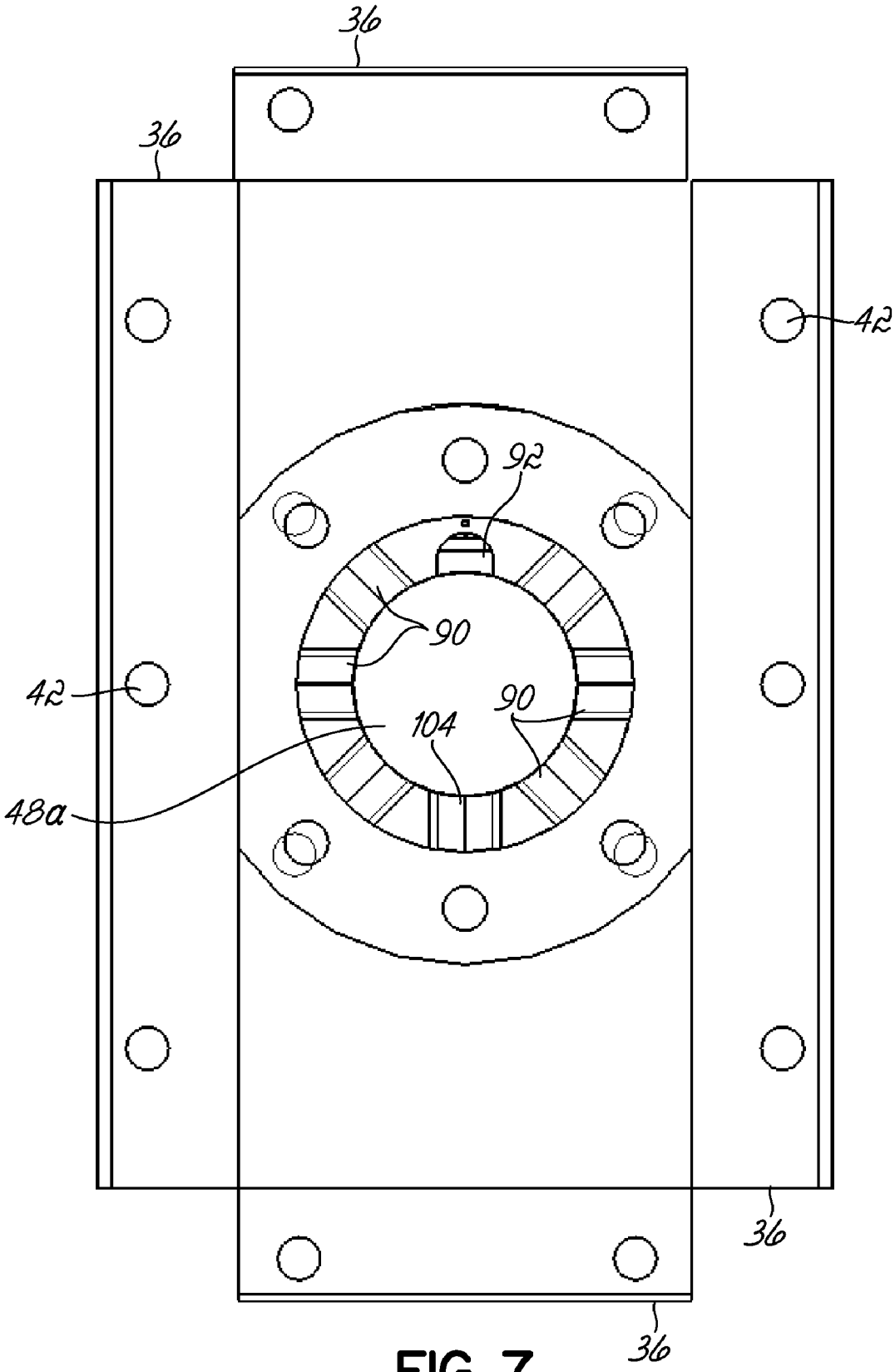
FIG. 7 is a top view of the housing of the mounting apparatus of FIGS. 1-6.

With particular reference to FIG. 5B, and as suggested by arrow 80, the mounting element 24 is rotatable about the vertical axis 25 relative to the housing 30. In this regard, an upper end of the sleeve 68 projecting into an interior of the housing 30 includes a plurality of slots 90 (FIG. 7) that are engageable by a pin 92 associated with the mounting element 24, and which, in this embodiment, is coupled to the shaft 48. Engagement of the pin 92 within each of the slots 90 selectively locks the angular position of the mounting element 24 relative to the housing 30. An alternative embodiment is contemplated in which the pin 92 is instead associated with the housing 30 and the slots 90 form part of the mounting element 24, with such embodiment considered to fall within the scope of the present disclosure.

With particular reference to FIG. 5C, the sleeve 68 restricts downward movement of the mounting element 24 relative to the housing 30 when mounting element 24 is in any of the predetermined angular positions of the mounting element 24, other than the angular position of the mounting element 24 when it sits within cavity 29 of the housing 30. More specifically, each of the slots 90 defines a base 100 forming part of sleeve 68 and which is engaged by the pin 92, to thereby restrict downward movement of the mounting element 24 relative to the housing 30. In the angular position of mounting element 24 in which mounting element 24 is received within cavity 29 of housing 30, downward movement of mounting element 24 into cavity 29 is permitted by sliding movement of pin 92 along a channel 104 of sleeve 68 (FIG. 3). More specifically, mounting element 24 is permitted to move downward, in that predetermined angular position, until pin 92 engages a base 106 (FIG. 3) of the channel 104. Moreover, in this embodiment, the downward force exerted by the spring 60 onto mounting element 24 when the mounting element 24 is in the fully extended position (FIGS. 5B, 5C) further secures the pin 92 within the slot 90 with which pin 92 is engaged, thereby restricting upward movement of mounting element 24 during use.

Figure 6:
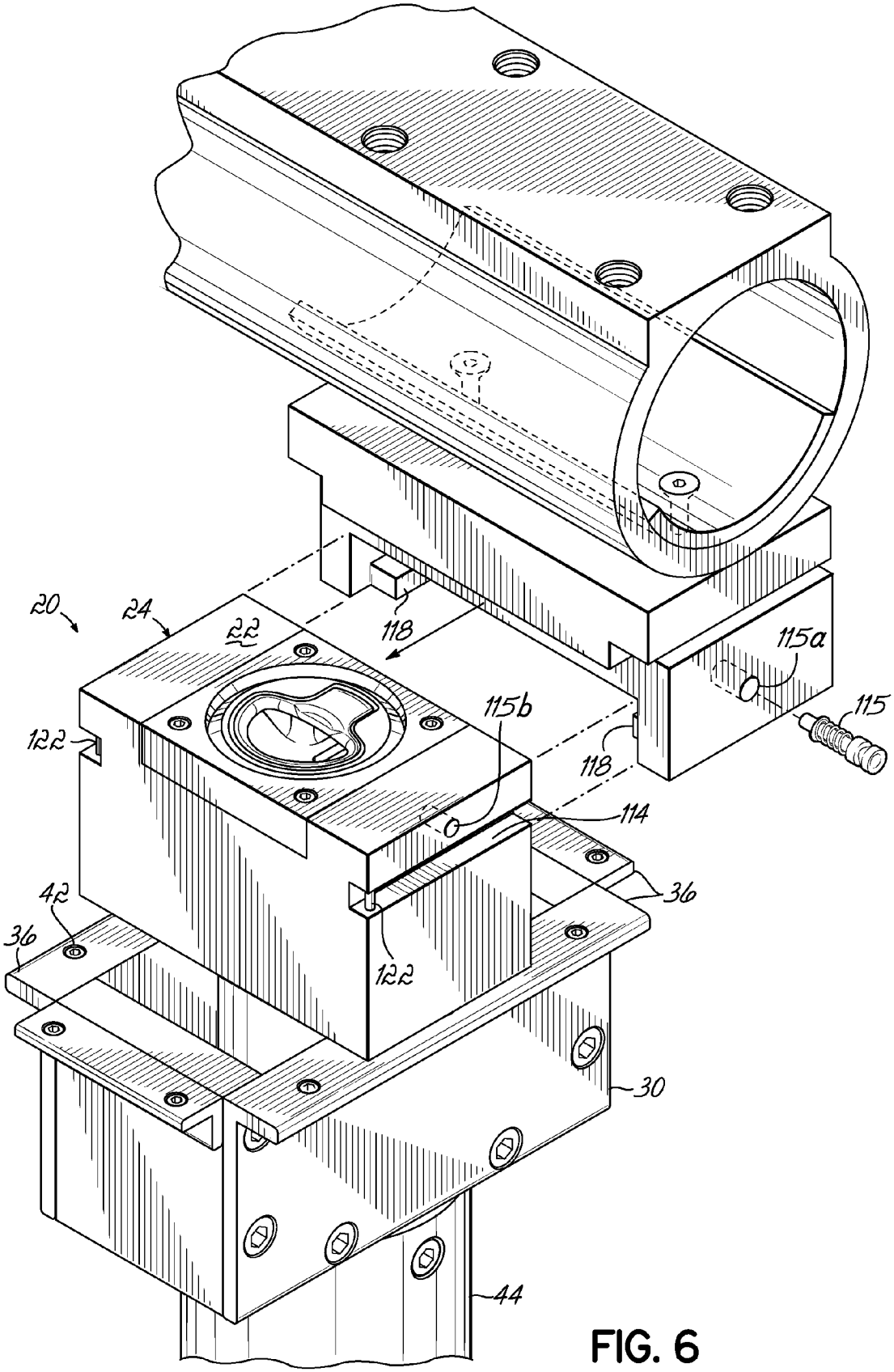
FIG. 6 is a partially broken away perspective view of the mounting apparatus of FIGS. 1-4 receiving an exemplary accessory for coupling therewith.

With reference to FIG. 6, an exemplary accessory 110 is illustrated being releasably coupled to the mounting apparatus 20 of the preceding figures. In particular, the mounting element 24 has a first engaging portion in the form, in this embodiment, of a pair of laterally opposed channels 114 that slidingly receive a corresponding pair of protrusions 118, such as keys, defining a cooperating, second engaging portion of the accessory 110. A limiting pin 122 in each of the channels 114 limits the horizontal position of the accessory 110 relative to the mounting element 24. Once the protrusions 118 are fully received within the channels 114, a locking feature may secure the accessory 110 in place, relative to the mounting element 24, with this locking feature taking a suitably chosen form. In the illustrated embodiment, for example, and without limitation, the accessory 110 includes a spring-loaded pin 115 that is permanently secured in a bore 115*a* of the accessory 110. The pin 115 is received within a hole 115*b* when the protrusions 118 reach a predetermined position along the channels 114.

In use, a user would pull the pin 115 against the urging force exerted by the spring of the pin 115, and the protrusions 118 are then slid into engagement with the channels 114. Once the pin 115 is in registration with the hold 115*b*, the force of the spring associated with the pin 115 causes the pin to be received within the hole 115*b*, thereby locking the accessory 110 in place i.e., restricting the horizontal position of the accessory 110 relative to the mounting element 24. While the illustrated embodiments include one or more protrusions 118 in the accessory 110 that cooperate with one or more corresponding channels 114 in the mounting element 24, it is contemplated that the one or more protrusions 118 may instead form part of the accessory 110, while the one or more channels 114 may form part of the mounting element 24.

In the exemplary embodiment of FIG. 6, the accessory 110 is shown to be in the form of a fishing rod holder. Those of ordinary skill in the art, however, will readily appreciate that this is merely exemplary rather than limiting, as any other type of accessory may instead be engaged with the mounting element 24. For example, and without limitation, such alternative accessory may be in the form of a ladder, a grill, a trolling motor, a kicker motor, an electronic device, a table, a wakeboard tower, a canoe outrigger, a ski and wakeboard rack, a fishing downrigger, a rocket-type rod holder, a T-top style top, a diving tank holder, an umbrella, or a camera mount. In this regard, the plurality of available angular positions of the mounting element 24 that is facilitated by the rotatability thereof about axis 25 permits attachment of accessories that may require specific orientations. For example, and without limitation, an accessory 110 in the form of a table may be rotated into a desired orientation in accordance with a user's preference, for example to maximize the available number of seating spaces in front of such table.

When the user desires to couple a different accessory to the boat 10, the user decouples the accessory 110 from the mounting element 24, and replaces it with a different accessory, for example, following the process illustrated in FIG. 6. Similarly, when coupling of the accessory 110 to the boat 10 is no longer needed, the accessory 110 is decoupled from the mounting element 24, the mounting element 24 is then rotated to coincide with the general orientation of the cavity 29 (FIG. 4) of the housing 30, and the mounting element 24 is permitted to retract, along with the shaft 48, respectively into the housing 30 and encasement 44. The retracting movement of the mounting element 24 into the housing 30 is facilitated by the downward force exerted by the spring 60 which, as discussed above, urges the mounting element 24 downward when the mounting element 24 is in the fully extended position.

While the present invention has been illustrated by a description of various preferred embodiments and while these embodiments have been described in some detail, it is not the intention of the Applicant to restrict or in any way limit the scope of the appended claims to such detail. Additional advantages and modifications will readily appear to those skilled in the art. The various features of the invention may be used alone or in any combination depending on the needs and preferences of the user. This has been a description of the present invention, along with the preferred methods of practicing the present invention as currently known. However, the invention itself should only be defined by the appended claims.

What is claimed is:

1. A mounting apparatus for selectively securing one of a plurality of accessories to a structural portion of a boat, comprising:

a housing configured for coupling to the structural portion of the boat;

a mounting element at least partially disposed in said housing and movable relative thereto along an axis between a retracted position and an extended position above the structural portion, said mounting element being rotatable about said axis relative to said housing and including a first engaging portion for selectively coupling thereto a cooperating second engaging portion of the accessory, said mounting element including a top face and said housing including a flange for coupling said housing to the structural portion of the boat and positioned relative to a remainder of said housing so as to make said top face substantially flush with a top surface of the boat when said flange is coupled to the structural portion of the boat;

a pin associated with one of said mounting element or said housing;

a plurality of slots in the other of said mounting element or said housing and adapted to receive said pin;

rotation of said mounting element about said axis defining a plurality of available angular positions of the mounting element relative to said housing; and selective engagement of the pin with one of said slots being effective to lock said mounting element in a predetermined one of said available angular positions thereof.

2. A boat comprising the mounting apparatus of claim 1.

3. A mounting apparatus for selectively securing one of a plurality of accessories to a structural portion of a boat, comprising:

a housing configured for coupling to the structural portion of the boat;

a mounting element at least partially disposed in said housing and movable relative thereto along an axis between a retracted position and an extended position above the structural portion, said mounting element being rotatable about said axis relative to said housing and including a first engaging portion for selectively coupling thereto a cooperating second engaging portion of the accessory; and an encasement extending from said housing and including a biasing element urging said mounting element in a direction toward said retracted position.

4. The mounting apparatus of claim 3, wherein said first engaging portion includes a channel for slidably receiving a cooperating protrusion of the second engaging portion of the accessory.

5. A boat comprising the mounting apparatus of claim 3.

6. A mounting apparatus for selectively securing one of a plurality of accessories to a structural portion of a boat, comprising:

a housing configured for coupling to the structural portion of the boat;

a mounting element at least partially disposed in said housing and movable relative thereto along an axis between a retracted position and an extended position above the structural portion, said mounting element being rotatable about said axis relative to said housing and including a first engaging portion for selectively coupling thereto a cooperating second engaging portion of the accessory; and said mounting element including a latch and said housing including a stop member selectively engageable by said latch to lock said mounting element in said retracted position.

7. The mounting apparatus of claim 6, further comprising:

a pivotally-mounted element operatively coupled to said latch for selectively engaging and disengaging said latch relative to said stop member.

8. An accessory mounting system comprising the mounting apparatus of claim 6 and further comprising:

a boat accessory having the second engaging portion thereon and configured for selective coupling with said first engaging portion of said mounting element.

9. A boat comprising the mounting apparatus of claim 6.

10. A mounting apparatus for selectively securing one of a plurality of accessories to a structural portion of a boat, comprising:

a housing having an axis and configured for coupling to the structural portion of the boat with the axis thereof generally vertical and generally perpendicular to a top surface of the boat;

a mounting element at least partially disposed in said housing and movable axially relative thereto along the axis between a retracted position and an extended position above the structural portion, said mounting element being rotatable about said axis relative to said housing and including a first engaging portion for selectively coupling thereto a cooperating second engaging portion of the accessory, said mounting element including a top face and said housing including a flange for coupling said housing to the structural portion of the boat and positioned relative to a remainder of said housing so as to make said top face substantially flush with the top surface of the boat when said flange is coupled to the structural portion of the boat and the mounting element is in the retracted position; and a locking feature on the first engaging portion for securing the second engaging portion of the accessory relative to the first engaging portion of said mounting element, the locking feature including one of (a) a releasable member moveably secured in a bore in one of said portions and (b) a hole or other recess formed in the other of said portions for receiving the releasable member and configured to releasably couple said portions together until manually released by a user.

11. A boat comprising the mounting apparatus of claim 10.

12. A mounting apparatus for selectively securing one of a plurality of accessories to a structural portion of a boat, comprising:

a housing configured for coupling to the structural portion of the boat;

a mounting element at least partially disposed in said housing and movable relative thereto along an axis between a retracted position and an extended position above the structural portion, said mounting element being rotatable about said axis relative to said housing and including a first engaging portion for selectively coupling thereto a cooperating second engaging portion of the accessory;

said mounting element including a top face and said housing including a flange for coupling said housing to the structural portion of the boat and positioned relative to a remainder of said housing so as to make said top face substantially flush with a top surface of the boat when said flange is coupled to the structural portion of the boat; and a pivotally-mounted lifting element coupled to said mounting element and engageable to move said mounting element upward toward said extended position, said lifting element having a folded orientation in which said lifting element is generally flush with said top face.

13. A boat comprising the mounting apparatus of claim 12.

14. A mounting apparatus for selectively securing one of a plurality of accessories to a structural portion of a boat with the accessory supported at an exposed top surface of the boat, comprising:

a housing configured for coupling to the structural portion of the boat;

a mounting element at least partially disposed in said housing and movable relative thereto along an axis between a retracted position and an extended position above the structural portion, said mounting element being rotatable about said axis relative to said housing and including a first engaging portion for selectively coupling thereto a cooperating second engaging portion of the accessory;

said housing having a spring connected to the mounting element to urge said mounting element along said axis toward an intermediate position partially disposed in said housing when said mounting element is in said retracted position; and when said mounting element is in said extended position, said mounting element being rotatable about said axis to define a plurality of available angular positions thereof relative to said housing, said spring urging said mounting element downward so as to secure said mounting element in one of said angular positions.

15. The mounting apparatus of claim 14, wherein said mounting element includes a pair of channels for slidingly receiving a corresponding pair of protrusions of the accessory.

16. The mounting apparatus of claim 14, further comprising:

a pin associated with one of said mounting element or said housing; and a plurality of slots in the other of said mounting element or said housing and adapted to receive said pin, selective engagement of the pin with one of said slots being effective to lock said mounting element in a predetermined one of said available angular positions thereof.

17. The mounting apparatus of claim 14, wherein rotation of said mounting element about said axis is effective to lock a vertical position of said mounting element relative to said housing.

18. A boat comprising the mounting apparatus of claim 14.

19. A mounting apparatus for selectively securing one of a plurality of accessories to a structural portion of a boat, comprising:

a housing configured for coupling to the structural portion of the boat;

a mounting element at least partially disposed in said housing and movable relative thereto along an axis between a retracted position and an extended position above the structural portion, said mounting element being rotatable about said axis relative to said housing and including a first engaging portion for selectively coupling thereto a cooperating second engaging portion of the accessory; and a biasing element urging said mounting element in a direction toward said extended position when said mounting element is in said retracted position and urging said mounting element in a direction toward said retracted position when said mounting element is in said extended position.

20. A boat comprising the mounting apparatus of claim 19.

21. An accessory mounting system for supporting a boat accessory at an accessible surface of a boat having a structural portion behind the accessible surface, the system comprising:

a housing configured for coupling to the structural portion of the boat behind the accessible surface thereof;

a mounting element at least partially disposed in said housing and movable relative thereto between a retracted position and an extended position above the accessible surface when the housing is coupled to the structural portion, said mounting element including a first engaging portion;

a biasing element urging said mounting element in a direction toward said retracted position;

a lifting element coupled to said mounting element and engageable to move said mounting element upward toward said extended position; and a boat accessory having a second engaging portion for selective engagement thereof with said first engaging portion of said mounting element.

22. The system of claim 21, further comprising:

a plurality of boat accessories having respective second engaging portions, each selectively engageable with the said first engaging portion of said mounting element.

23. The system of claim 21, wherein said mounting element is moveable along an axis in the housing between the retracted position and the extended position and is rotatable about said axis in the extended position to thereby define a plurality of available angular positions of said mounting element relative to said housing, said biasing element urging said mounting element in a direction toward said retracted position in said angular positions.

24. The system of claim 23, further comprising:

a pin associated with said mounting element; and a plurality of slots in said housing adapted to receive said pin, selective engagement of said pin with one of said slots being effective to lock said mounting element in a predetermined one of said available angular positions of said mounting element.

25. The system of claim 23, further comprising:

locking structure in said housing adapted to selectively engage said mounting element and effective to lock said mounting element when so engaged in a predetermined one of said available angular positions of said mounting element.

26. A boat comprising the mounting system of claim 21.

27. The boat of claim 26 wherein said mounting element includes a top face and said housing is coupled to the structural portion of the boat and positioned relative to a remainder of said housing so as to make said top face substantially flush with a top surface of the boat.

* * * * *